US008207730B2

(12) United States Patent
Martin et al.

(10) Patent No.: US 8,207,730 B2
(45) Date of Patent: Jun. 26, 2012

(54) METHOD AND DEVICE FOR DETERMINING THE EXISTENCE AND LOCATION OF STRESS-INDUCING FORCES ON A ROD

(75) Inventors: Jean-Pierre Martin, Garches (FR); Phillippe Broun, Saint-Egreve (FR); Jean-Paul Bongiraud, Varces Allieres et Risset (FR); Vincent Bongiraud, legal representative, Le Villard (FR); Jean-Louis Coulomb, Saint-Ismier (FR)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/436,006

(22) Filed: May 5, 2009

(65) Prior Publication Data

US 2010/0018306 A1 Jan. 28, 2010

Related U.S. Application Data

(63) Continuation of application No. 12/255,088, filed on Oct. 21, 2008, now abandoned, which is a continuation of application No. PCT/FR2007/051153, filed on Apr. 20, 2007.

(30) Foreign Application Priority Data

Apr. 21, 2006 (FR) ..... 06 03524

(51) Int. Cl.
*G01R 33/18* (2006.01)

(52) U.S. Cl. ..... 324/209; 73/862.333

(58) Field of Classification Search ..... 324/209; 73/779, 862.333, 862.69
See application file for complete search history.

(56) References Cited

U.S. PATENT DOCUMENTS

| | | | |
|---|---|---|---|
| 2,558,427 | A | 6/1951 | Fagan |
| 2,770,773 | A | 11/1956 | Cooley |
| 2,892,151 | A | 6/1959 | Bender |
| 2,897,438 | A | 7/1959 | Fearon |
| 2,964,699 | A | 12/1960 | Perriam et al. |
| 3,004,427 | A | 10/1961 | Berry |
| 3,233,170 | A | 2/1966 | Rogers |

(Continued)

FOREIGN PATENT DOCUMENTS

EP 196829 A2 10/1986

(Continued)

*Primary Examiner* — Bot L LeDynh
(74) *Attorney, Agent, or Firm* — Schwegman, Lundberg & Woessner, P.A.

(57) ABSTRACT

The present invention relates to methods for determining the existence and location of parasitic stress-inducing forces on a substantially cylindrical rod portion defined along a first axis and when this rod is made of a magnetostrictive material. The method according to the invention is essentially characterized in that it consists in magnetizing the wall of the rod portion in a pseudo-helix 10 centered on the first axis, in applying a forced stress between the two ends of the rod portion, in measuring, along the rod portion, the magnitude of the magnetic field created by the rod portion after it has been subjected to the forced stress, these measurements being taken in a direction substantially parallel to the first axis, and from these measurements, in deducing the existence and location of the parasitic stress-inducing forces on the rod portion. The invention also relates to a device for implementing this method. Advantageous application to the determining of the location of a sticking point Pc of a hollow drill rod string which has become stuck in an oil well.

18 Claims, 2 Drawing Sheets

U.S. PATENT DOCUMENTS

| | | | | |
|---|---|---|---|---|
| 3,449,662 | A | | 6/1969 | Fenton |
| 3,535,624 | A | | 10/1970 | Fenton |
| 3,639,861 | A | * | 2/1972 | Russen ..... 333/201 |
| 3,845,381 | A | | 10/1974 | Hart |
| 4,310,796 | A | | 1/1982 | Braithwaite et al. |
| 4,708,204 | A | | 11/1987 | Stroud |
| 4,766,764 | A | | 8/1988 | Trevillion |
| 4,789,827 | A | | 12/1988 | Bergander |
| 4,808,925 | A | | 2/1989 | Baird |
| 4,825,166 | A | | 4/1989 | MacGugan |
| 5,293,117 | A | | 3/1994 | Hwang |
| 5,375,476 | A | | 12/1994 | Gray |
| 6,198,277 | B1 | | 3/2001 | Porter et al. |
| 7,038,444 | B2 | | 5/2006 | Crouch et al. |
| 7,389,183 | B2 | | 6/2008 | Gray |
| 7,403,000 | B2 | | 7/2008 | Barolak et al. |
| 7,990,138 | B2 | | 8/2011 | Martin et al. |
| 8,076,940 | B2 | | 12/2011 | Martin et al. |
| 2010/0045278 | A1 | | 2/2010 | Martin et al. |
| 2010/0156403 | A1 | | 6/2010 | Martin et al. |
| 2010/0181994 | A1 | | 7/2010 | Martin et al. |

FOREIGN PATENT DOCUMENTS

| | | | |
|---|---|---|---|
| GB | 850733 | A | 10/1960 |
| GB | 2158245 | A | 11/1985 |
| JP | 55101044 | | 8/1980 |
| JP | 02218953 | | 8/1990 |
| WO | WO-84001627 | A1 | 4/1984 |

* cited by examiner

METHOD AND DEVICE FOR DETERMINING THE EXISTENCE AND LOCATION OF STRESS-INDUCING FORCES ON A ROD

RELATED APPLICATIONS

This application is a continuation of U.S. patent application Ser. No. 12/255,088 Filed Oct. 21, 2008, now abandoned which is a continuation under 35 U.S.C. 111(a) of International Application No. PCT/FR2007/051153, filed Apr. 20, 2007, and published as WO 2007/122357 A1, on Nov. 1, 2007, which claimed priority under 35 U.S.C. 119 to French Patent Application Ser. No. 0603524, filed Apr. 21, 2006, which application and publication are incorporated herein by reference and made a part hereof.

The present invention concerns methods for determining the existence and the location of stress forces being applied to a portion of hollow tube made of a magnetostrictive material, which find a particularly advantageous application in determining the location of a point at which a hollow rod made of a magnetostrictive material is stuck in an oil well or similar, and in particular the location of the sticking point of a string of rods used in drilling an oil well or similar.

The present invention also concerns, by way of application, the methods for determining the location of the neutral point of a string of drilling rods in relation to the point of sticking, and possibly creating such a neutral point at a specific location.

The present invention also concerns devices allowing these methods to be implemented.

It is know that, in drilling an oil well, for example, a hollow drilling rod is used, which is made up of an assembly of successive rod portions called a "rod string", the penetrating end of which includes means of drilling. These drilling devices are well-known in and of themselves, so their use will not be described more fully here.

More particularly in the field of petroleum engineering, these rod strings can attain very sizable lengths of several thousand meters and are sometimes subject to unintentional jamming, which prevents the continued drilling of the well and/or backing out of the rod string. These jams may, for example, result from encountering obstacles, collapses, etc.

Given that such a jam generally occurs at a great depth, it is quite obvious that it is impossible to abandon the rod-string assembly and/or the drill tool, or the portion of the well already executed.

It is therefore imperative to recover the maximum length of the rod string in order to recover the maximum number of drilling elements and to continue drilling the well.

With this aim, various techniques have been developed which can be implemented, with the condition that the location of the jam be determined relatively accurately.

In the case of drilling an oil well using a drill-rod string screwed end to end, the locations of the ends of the rod portions need to be determined which are located just on either side of the jam.

Various methods for determining the position of the point where a drill-rod string is stuck are already known, for example those described in the patents EP-A-196 829 and U.S. Pat. No. 4,766,764.

The method described in the first document cited consists essentially of lowering, step by step along the entire length of the rod string, a first tool, which produces magnetic-field pulses creating magnetic markers in the rods in an incremental fashion, of lowering a second tool to make a measurement of the first magnetic-field value at all the markers set by the first tool, of subjecting the rod string to mechanical stresses, and finally of determining the markers whose magnetic-field value has undergone a change relative to the first value. Pinpointing the location of two consecutive magnetic markers appearing, one the change in the magnetic field and the other unchanged, defines the position of the jam in the rod string as being between the two points.

As for the method described in the second document, it consists of subjecting the rod string to torsion after having set the magnetic markers step by step, of measuring the magnetic field of these markers by tracing a generatrix of the rod before torsion, and of pinpointing the location of the first marker, which has moved away from this generatrix, as its removal leads to a reduction in its magnetic field. Pinpointing this marker defines the location of the point of the jam. The method described in the patent GB-A-2 158 245 is also known, which requires a magnetic excitation step in the rod string and two supplementary steps consisting of making two measurements before and after having subjected the rod string to a mechanical stress, then a comparison of the results of the two measurements in order to determine the point of the jam.

These prior methods are relatively long and at the same time difficult to implement and are sometimes not reliable.

The present invention also has the goal of implementing a method for determining, in a general way, the location of stress forces capable of being applied to a rod portion, and more particularly a portion of hollow tube, and in particular, as an advantageous application, for determining the location of the point at which a hollow rod made of a magnetostrictive material is stuck, for instance, in a well or similar, which compensates for a large number of the drawbacks mentioned above in the techniques used to date, that is, a method that allows the location of that jamming point to be accurately determined, much more rapidly and easily than with the methods of prior art, and especially thanks to the emission of high-amplitude signals that contribute to achieving an easy and more accurate measurement, and which allows for controlled magnetization of the rod and/or the tube much more readily than, for example, the implementation of the method described in the patent U.S. Pat. No. 4,766,764 mentioned above.

More accurately, the present invention has the objective of a method for determining the existence and location of parasitic stress forces on a roughly cylindrical rod portion defined along a first axis and when this rod is made of a magnetostrictive material, characterized by the fact that it consists, successively, of:

- achieving magnetization of the wall of said rod portion tracing a pseudo-helix centered on the first axis,
- applying a forced stress between the two ends of said rod portion,
- measuring, along the length of the rod portion, the value of the magnetic field created by magnetizing the wall of said rod portion after it had been subjected to the forced stress, these measurements being made by tracing a direction roughly parallel to said first axis, and
- deducing, from said measurements, the existence and the location of parasitic stress forces on said rod portion.

The present invention also has the objective of a device for implementing the method defined above in order to determine the existence and the location of parasitic stress forces on a roughly cylindrical rod portion defined along a first axis, when this rod is made of a magnetostrictive material and is made up of a portion of hollow tube, characterized by the fact that it includes;

an envelope made of a non-magnetic material, said envelope being laid out in such a way as to able to penetrate into said portion of hollow tube, means for controlling the translation of said envelope into and along said tube portion, a source capable of producing a magnetic field tracing a second, so-called "magnetization" axis, means for mounting said source at a first location on the inside of said envelope and of setting it in rotational motion about a third axis roughly parallel to said first axis of the hollow tube, means for measuring the value of the magnetic field in at least a second location in said envelope and of delivering a signal representative of the value of the magnetic field at this second location, means for placing the different values of said signal into memory, depending on the indexing of the position of said second location relative to a given point on the portion of hollow tube when the envelope is moved into and along said hollow tube between its two ends. Other characteristics and advantages of the present invention will appear in the course of the following description, which is given with reference to the illustrative but not limiting drawings attached, in which:

FIG. 1 schematically represents a rod portion on which is depicted, by a solid line, a line tracing along which, according to one phase of the method, magnetization of this rod portion is achieved.

Figure 1:
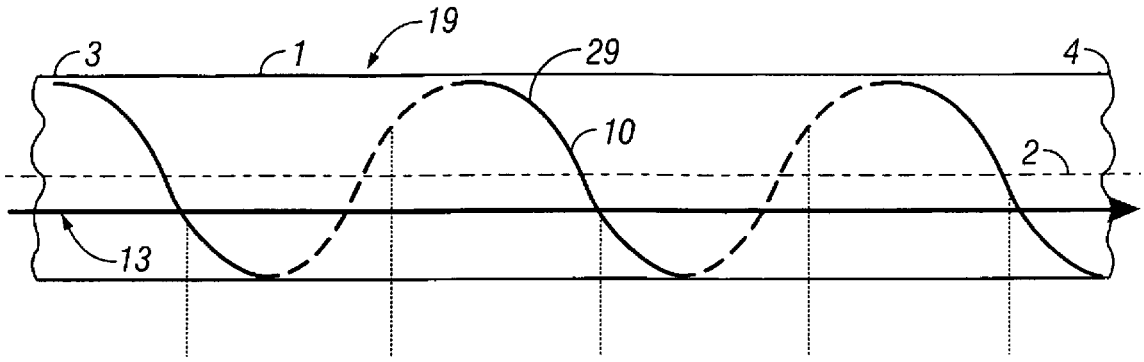
Figure 2:
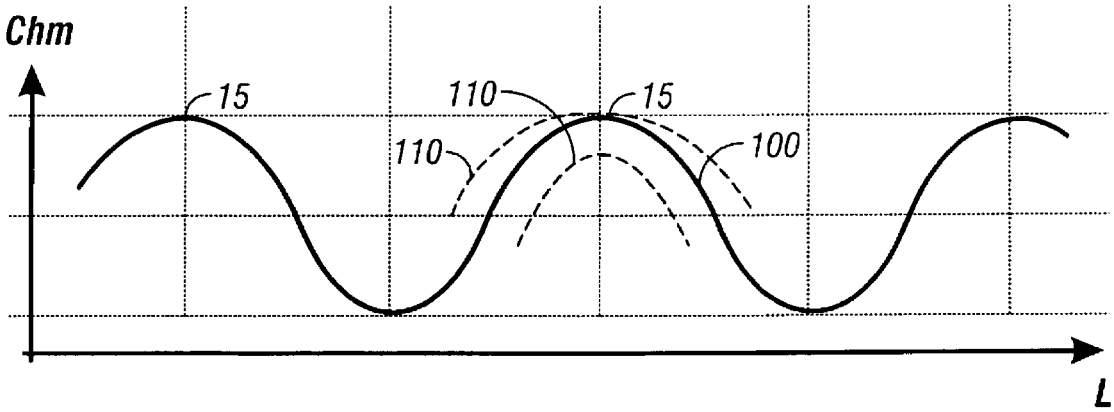
FIG. 2 represents, in the form of a schematic curve, the amplitude of the magnetic field Chm along a generatrix of the rod portion following its magnetization according to FIG. 1.
Figure 3:
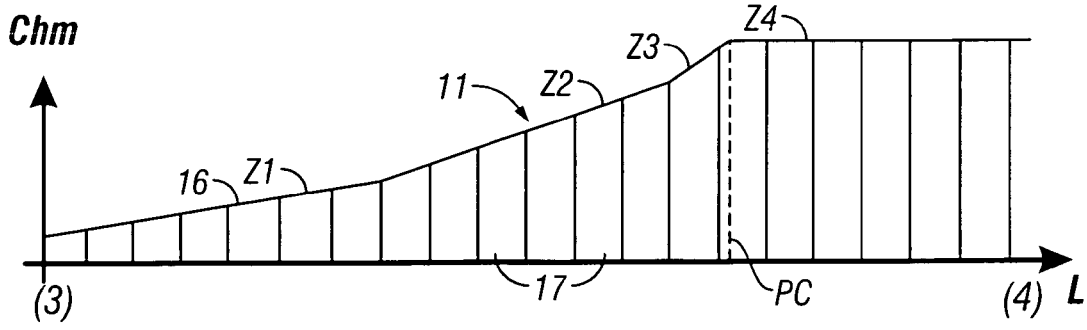
FIG. 3 represents a graph, on a smaller scale than those of FIGS. 1 and 2, illustrating the maximum values of the magnetic field Chm along the same generatrix after the rod portion has been subjected to a stress, and FIG. 4 schematically represents an embodiment of a device allowing the method according to the invention to be implemented.
Figure 4:
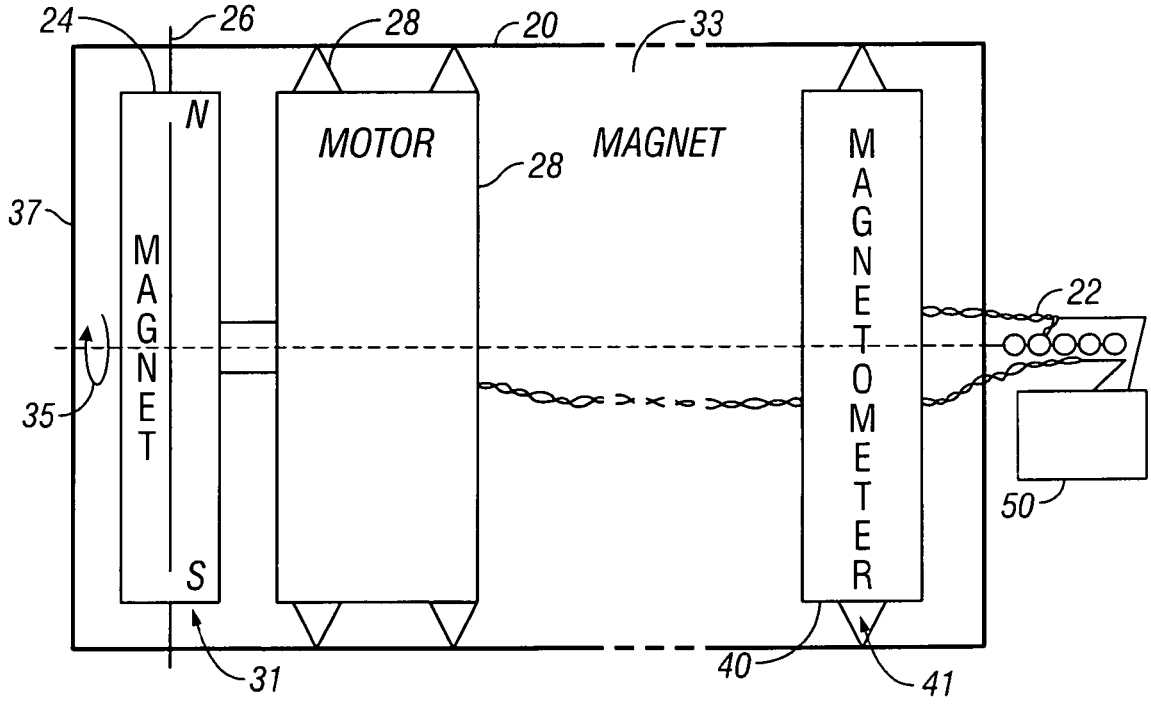

First of all, it is stated that FIGS. 1 to 3 clarify the implementation of the method according to the invention and that FIG. 4 represents one embodiment of the device according to the invention, but that there may be other embodiments that answer to the definition of this invention.

It is stated moreover that when, according to the definition of the invention, the object of the invention, whatever it may be, includes "at least one" element having a given function, the embodiment described may include several of these elements. Reciprocally, if the embodiment of the object according to the invention as illustrated includes several elements of identical function and if, in the description, it is not specified that the object according to the invention must necessarily include a specific number of these elements, the object of the invention could be defined as including "at least one" of these elements.

Finally, it is stated that when, in the present description, an expression defines, by itself, without any particular mention specifically related to it, a collection of structural characteristics, these characteristics may be taken as the definition of the object of the protection requested, when this is technically possible, either separately or in total and/or partial combination.

In the description given hereinafter of the method according to the invention for determining the existence and the location of stress forces on a rod portion 1 in FIG. 1, defined along a first axis 2 and made of a magnetostrictive material, these so-called "parasitic" stress forces may be of any origin whatever, unintentional, deliberates, useful, or harmful.

The method according to the invention consists, successively, of:

magnetizing the wall 29 of the rod portion 1, tracing a pseudo-helix 10 centered on the first axis 2, the term "pseudo-helix" being defined hereinafter, applying, between the two ends 3, 4 of the rod portion 1, a so-called "forced" stress, in the sense of the present description, to differentiate it from the. "parasitic" stress, making measurements 11, along the length of the rod portion 1, of the value of the magnetic field Chin created by magnetizing the wall of the rod portion 1 after it has been subjected to the forced stress, these measurements being made by tracing a direction roughly parallel to the first axis 2, for instance either selectively along a generatrix of this rod portion or successively on all or part of planes roughly perpendicular to the axis 2 of the rod portion along its length, and deducing, from these measurements 11, the existence and the location of the parasitic stress forces on the rod portion 1.

It is stated that, in the sense of the present description, the term "pseudo-helix" defines a curve described by a point that undergoes two simultaneous motions, a first motion tracing a given direction that may be rectilinear or not but that is continuous in any case, and a second rotational motion about and at some non-zero distance from an axis of rotation parallel to the given direction of translation, adding too that the rates of rotation and of translation are never zero and that they can be modulated in amplitude.

This means that the term "pseudo-helix" may therefore include a true helix in the mathematical sense if the rates of translation and of rotation are constant along the length of the rod and if the axis of rotation defined above is a straight line. But it may also be a curve comparable to a helix, without actually being one.

FIG. 1 represents one form of this pseudo-helix 10 on a rod portion 1 defined between its two ends 3, 4, which in this case illustrates a true helix in the mathematical sense.

As for FIG. 2, it represents, in the form of a schematic curve, the amplitude of the magnetic field Chm along a generatrix 13 of the rod portion 1 of length L between its two ends 3, 4, following its magnetization accomplished during the first implementation phase of the method illustrated in FIG. 1. It is seen in this figure that the amplitude of the magnetization along this generatrix 13 is deduced from the magnetization curve 10 according to FIG. 1 and that the maximum amplitudes of all the waves (either periodic or pseudo-periodic) are all equal.

It is furthermore stated that it is impossible to obtain a selective, or comparable, magnetization, tracing a linear curve such as that illustrated by 100, FIG. 2. Actually, such a magnetization is accomplished over a non-negligible breadth that traces the pseudo-helix 10. This breadth is drawn schematically by dashed lines 110 on FIG. 2.

In order to avoid overlapping of two successive half-waves, the pitch of the pseudo-helix will therefore be chosen sufficiently large as to obtain a curve like that illustrated in FIG. 2.

It may also be recalled that, when a rod, made of a magnetostrictive material and placed in a given magnetic state, for instance, induced by a magnetic field created by a given source such as one of those defined hereinafter, is subjected to a forced mechanical stress, its magnetization diminishes more and more in the proper demagnetizing field of said rod, as a function of the intensity of this stress. This phenomenon is well known to experts.

As for the nature of the forced mechanical stress, it is one of the following mechanical stresses: torsion, traction, compression, a combination of torsion and traction, a combination of torsion and compression.

Within the framework of implementing the method according to the invention, this forced stress may be accomplished according to one of the two following processes: application of the mechanical stress prior to the step of measuring the magnetic field and maintaining the stress while this measurement is being made, or else application of the stress and relaxation from this stress before making the measurement.

According to an advantageous implementation of the method, the deduction, from the measurements 11 defined above, of the existence and the location of the parasitic stress forces on the rod portion 1 is performed using a graph 16 such as that depicted in FIG. 3, which represents the maximum amplitudes 17 of the magnetic field measured at the peaks 15 of the curve 100, FIG. 2.

The maximum amplitudes of the magnetic field measured along the length of the rod portion 1, between its end 3 and its end 4, after it has been subjected to the forced stress at its end 3, on a generatrix 13 roughly parallel to the first axis 2, are illustrated on the graph according to FIG. 3.

This graph contains four zones Z1 to Z4. Zone Z1 corresponds to the part of the rod portion 1 that is not subjected to any parasitic stress and is only subject to the forced stress. This zone Z1 is followed by one or both of two zones Z2 and Z3, which correspond, for example, to the appearance of a parasitic stress that is beginning to be applied to the rod portion 1, but has not reached a point of complete blockage, which is itself located at point Pc. In zone Z4, which follows zone Z3 and begins at point Pc, the maximum amplitudes of the magnetic field are all roughly equal, which means that the forced stress is not applied beyond point Pc and that the rod portion is therefore totally blocked at this point Pc.

It is possible to implement the method on the rod portion without prior magnetic treatment of this rod portion. But, in some cases, it may be advantageous, prior to magnetizing its wall tracing the pseudo-helix centered on the first axis 2 as mentioned above, to modify its initial remanent magnetization, by any means. Such means are well known in and of themselves to experts.

This modification may be of any type. It may be a total demagnetisation in order to suppress any remanent magnetisation of the rod portion 1, or a modification of the remanent magnetization in order to bring it to a well-defined threshold and to give it a non-zero but advantageously uniform value over the entire length of the rod portion 1. The magnetization of the wall 29 of the rod portion 1 in accordance with the pseudo-helix 10 centered on the first axis 2 will then be added to this initial uniform magnetization.

The present invention also concerns a device for implementing the method described above for determining the existence and the location of parasitic stress forces on a roughly cylindrical rod portion defined along a first axis 2, when this rod is made of a magnetostrictive material and is made up of a portion of hollow tube 19.

This device includes, FIG. 4, an envelope 20 made of a non-magnetic material, laid out in such a way as to able to penetrate into the portion of hollow tube 19 and means, represented schematically as 22, of controlling the translation of the envelope 20 into and along the length of the tube portion 19. These means are well-known in and of themselves and therefore will not be described more fully here, only to simplify the present description.

It also includes a source 24 capable of producing a magnetic field tracing a second, so-called "magnetization" axis 26, means 28 for mounting the source 24 at a first location 31 on the inside 33 of the envelope 20 and of setting it in rotational motion 35 about a third axis 37 roughly parallel to the first axis 2 of the hollow tube 19, means 40 of measuring the value of the magnetic field in at least a second location 41 in the envelope 20 and of delivering a signal representative of the value of the magnetic field at this second location 41, and means 50 for placing the different values of the signal into memory, depending on the indexing of the position of the second location 41 relative to a given point on the portion of hollow tube 19 when the envelope is moved into and along the hollow tube between its two ends 3, 4. These means, schematically represented as 50, may be of any type, such as a computer with a display screen or a paper-roll printer or similar.

In an advantageous manner, the first and second locations 31, 41 in the envelope 20 are not co-located and are disposed a distance from one another, so specified that the magnetic field delivered by the source 24 is roughly zero at the second location 41.

The source 24 capable of producing a magnetic field tracing a second so-called "magnetization" axis 26 is composed of at least one of the following elements: a magnetic coil or, preferably, a permanent magnet having a magnetization density, for example, on the order of 1 tesla and which presents an enormous advantage over a magnetic coil in not requiring a large amount of electrical power.

As for the means of mounting the source 24 at a first location 31 on the inside 33 of the envelope 20 and setting it in rotational motion 35 about a third axis 37 roughly parallel to the first axis 2 of the hollow tube 19, this may be an electric motor or similar. In certain applications, for example in the case of the application to determine the point at which a drill-rod string is stuck in an oil well or similar, the means may be a fluidic motor that uses the fluid running through the tube portion.

The means 40 for measuring the value of the magnetic field at least a second location 41 in the envelope 20 and of delivering a signal representative of this value are made up of magnetometer means that are themselves advantageously made up of at least one of the following sensors: a giant magnetoresistance (GMR) sensor, Honeywell brand, Series 1021 or 1022; a GMR sensor, NVE Corporation brand, Series AAH002-02 or AAH004-00.

Likewise, it is advantageously possible that, considering that it is impossible to provide a well-defined angular position for the envelope 20 in a very long tube portion 19, the magnetometer means include a plurality of magnetometers distributed over the entire circumference of the envelope 20 in such a way that all these magnetometers can analyze the whole periphery of the wall of the portion of hollow tube.

The device described above for implementing the previously described method is used in the following manner.

The envelope is introduced into the hollow tube 19 so that its end including the magnet 24 first penetrates into the tube by means of a first end of this tube. It is then translated in the tube at a specified translation rate, as explained previously, the magnet being simultaneously subjected to a rotational motion about the axis 37. The envelope runs the entire length L of the tube portion 19 whose wall is thus subject to magnetization tracing the pseudo-helix 10. When the envelope arrives at the other end of the tube, the rotation of the magnet is stopped and the tube portion is subjected to a forced stress, for example at its first end. The envelope is then brought back in translation toward the first end of the tube and, simultaneously, the magnetometer means are controlled so as to obtain a graph like that depicted in FIG. 3. From this graph, as previously clarified, it is possible to determine the existence and the location of parasitic stresses capable of being applied to the tube portion between its two ends 3, 4.

As mentioned above, the device finds a particularly advantageous application in determining the point at which a drill-rod string is stuck or in determining the neutral point of a drill-rod string, when this rod string is used in drilling wells for hydrocarbon surveys.

The method and the device are very interesting, due to the fact that they utilize signals that are of an essentially known periodicity, FIG. 3, and therefore, as any expert knows, are easier to process than non-periodic signals. But especially, the signals obtained may be of very high amplitude, due to the use of a high-strength permanent magnet, relative to base noise signals. The method and the devices therefore produce signals that allow the signal-to-noise ratio to be amplified in a significant manner and more easily than with the use of non-periodic signals. They are thus easier to analyze, particularly automatically, or even visually by a technician, who can read their representation, for instance, directly on a screen or paper tape.

What is claimed is:

1. A method to determine existence and location of parasitic stress forces on a rod portion defined along a first axis, said rod portion made of a magnetostrictive material and being a roughly cylindrical rod portion, the method comprising: acts that include, successively,:

magnetizing a wall of said rod portion, tracing a pseudo-helix centered on the first axis;

applying a forced stress between two ends of said rod portion;

making measurements, along a length of said rod portion, of a value of a magnetic field (Chm) created by the magnetization of the wall of said rod portion after it has been subjected to the forced stress, the measurements being made by tracing a direction roughly parallel to the first axis; and deducing, from the measurements, the existence and the location of the parasitic stress forces on said rod portion.

2. A method according to claim 1, wherein the deduction, starting from the measurements, of the existence and the location of the parasitic stress forces on said rod portion are made using a graph that represents maximum amplitudes of the magnetic field measured.

3. A method according to claim 1, wherein the method includes, prior to the magnetization of the wall of said rod portion tracing a pseudo-helix centered on the first axis, modifying an initial remanent magnetization of the wall of said rod portion.

4. A device to determine existence and location of parasitic stress forces on a roughly cylindrical rod portion defined along a first axis, the roughly cylindrical rod portion made of a magnetostrictive material and made up of a portion of a hollow tube, the device comprising:

an envelope made of a non-magnetic material, said envelope being laid out in such a way as to be able to penetrate into said portion of the hollow tube, said envelope having an inside;

means for controlling the translation of said envelope into and along said portion of the hollow tube;

a source capable of producing a magnetic field tracing a second axis, the second axis being a magnetization axis;

means for mounting said source at a first location on the inside of said envelope and for setting said source in rotational motion about a third axis roughly parallel to said first axis of the hollow tube;

means for measuring a value of the magnetic field in at least a second location in said envelope and for delivering a signal representative of the value of the magnetic field at said second location; and means for placing one or more values of said signal into memory, depending on an indexing of a position of said second location relative to a given point on said portion of the hollow tube when said envelope is moved into and along the hollow tube between its two ends.

5. A device according to claim 4, wherein the first and second locations in said envelope are not co-located and are disposed a distance from one another, so specified that the magnetic field delivered by said source is roughly zero at the second location.

6. A device according claim 4, wherein said source is composed of at least one of a magnetic coil or a permanent magnet.

7. A device according to claim 4, wherein the means for measuring the value of the magnetic field in the at least said second location in said envelope and for delivering the signal representative of the value is a magnetometer system.

8. A device according to claim 7, wherein the magnetometer system is composed of at least one a GMR sensor, Honeywell brand, Series 1021 or 1022 or a GMR sensor, NVE Corporation brand, Series AAH002-02 or AAH004-00.

9. A device according to claim 7, wherein said envelope has a circumference and the magnetometer system includes a plurality of magnetometers distributed over the circumference in its entirety such that all the magnetometers are operable to analyze a whole periphery of a wall of said portion of the hollow tube.

10. A device according to claim 4, wherein the device is configured as a device to determine a point at which a drill-rod string is stuck or as a device to determine a neutral point of a drill-rod string, when the drill-rod rod string is used to drill a well for hydrocarbon surveys.

11. A device according to claim 6, wherein the means for measuring the value of the magnetic field in the at least said second location in said envelope and for delivering the signal representative of the value is a magnetometer system.

12. A device according to claim 11, wherein the magnetometer system is composed of at least one a GMR sensor, Honeywell brand, Series 1021 or 1022 or a GMR sensor, NVE Corporation brand, Series AAH002-02 or AAH004-00.

13. A device according to claim 8, wherein said envelope has a circumference and the magnetometer system includes a plurality of magnetometers distributed over the circumference in its entirety such that all the magnetometers are operable to analyze a whole periphery of a wall of said portion of the hollow tube.

14. A device according to claim 5, wherein said source is composed of at least one of a magnetic coil a permanent magnet.

15. A device according to claim 5, wherein the means for measuring the value of the magnetic field in the at least said second location in said envelope and for delivering the signal representative of the value is a magnetometer system.

16. A device according to claim 15, wherein the magnetometer system is composed of at least one a GMR sensor, Honeywell brand, Series 1021 or 1022 or a GMR sensor, NVE Corporation brand, Series AAH002-02 or AAH004-00.

17. A device according to one claim 5, wherein the device is configured as a device to determine a point at which a drill-rod string is stuck or as a device to determine a neutral point of a drill-rod string when the drill-rod rod string is used to drill a well for hydrocarbon surveys.

18. A method according to claim 2, wherein the method includes, prior to the magnetization of the wall of said rod portion tracing a pseudo-helix centered on the first axis, modifying an initial remanent magnetization of the wall of said rod portion.

* * * * *